US005349808A

United States Patent [19]

Lorenz

[11] Patent Number: 5,349,808

[45] Date of Patent: Sep. 27, 1994

[54] YARN TWISTING DISC

[75] Inventor: Hellmut Lorenz, Remscheid, Fed. Rep. of Germany

[73] Assignee: Barmag AG, Remscheid, Fed. Rep. of Germany

[21] Appl. No.: 531,894

[22] Filed: Jun. 1, 1990

[30] Foreign Application Priority Data

Jun. 14, 1989 [DE] Fed. Rep. of Germany ..... 3919395

[51] Int. Cl.[5] ..... D01H 7/92; D01H 13/00

[52] U.S. Cl. ..... 57/339; 57/338

[58] Field of Search ..... 57/332, 337, 338, 339

[56] References Cited

U.S. PATENT DOCUMENTS

| | | | |
|---|---|---|---|
| 3,813,868 | 6/1974 | Lorenz | 57/77.4 |
| 3,901,011 | 8/1975 | Schuster | 57/77.4 |
| 3,964,248 | 6/1976 | Schuster | 57/77.4 |
| 4,018,041 | 4/1977 | Weigert et al. | 57/339 |
| 4,033,105 | 7/1977 | McNeight et al. | 57/77.4 |
| 4,051,655 | 10/1977 | Lorenz et al. | 57/77.4 |
| 4,115,987 | 9/1978 | Taniguchi et al. | 57/77.4 |
| 4,195,470 | 4/1980 | Sturhahn | 57/339 |
| 4,218,870 | 8/1980 | King | 57/337 X |
| 4,718,226 | 1/1988 | Schuster et al. | 57/337 |

FOREIGN PATENT DOCUMENTS

| | | | |
|---|---|---|---|
| 2306853 | 8/1974 | Fed. Rep. of Germany . | |
| 7623421 | 4/1977 | Fed. Rep. of Germany . | |
| 2708204 | 8/1978 | Fed. Rep. of Germany | 57/337 |
| 3126726 | 2/1987 | Fed. Rep. of Germany . | |

*Primary Examiner*—Daniel P. Stodola
*Assistant Examiner*—William Stryjewski
*Attorney, Agent, or Firm*—Bell, Seltzer, Park & Gibson

[57] ABSTRACT

A rotary yarn twisting disc which is adapted for imparting twist to an advancing yarn as part of a false twisting process. The disc has an annular yarn contacting peripheral surface which includes a first segment having a relatively high coefficient of friction and a relatively large radius of curvature, and a second segment having a relatively low coefficient of friction and a relatively small radius of curvature.

7 Claims, 3 Drawing Sheets

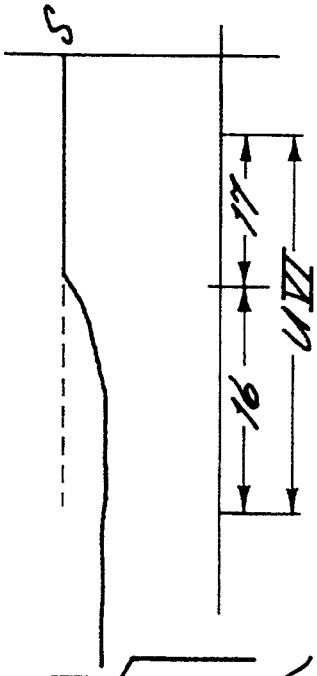
FIG. 6B.
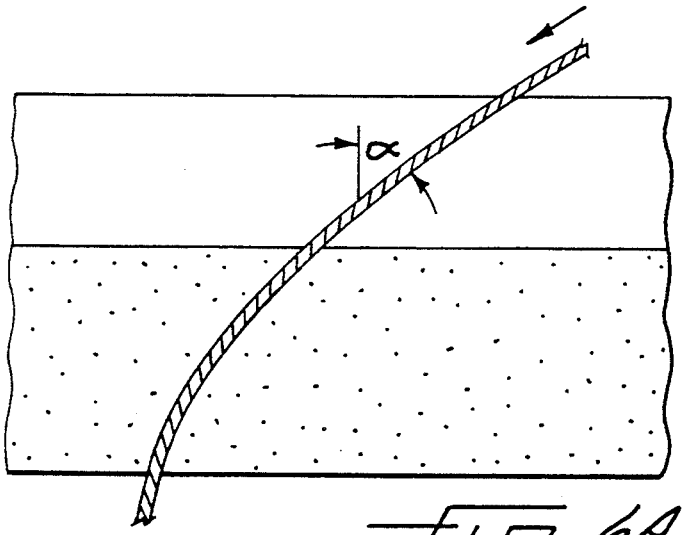
FIG. 6A.
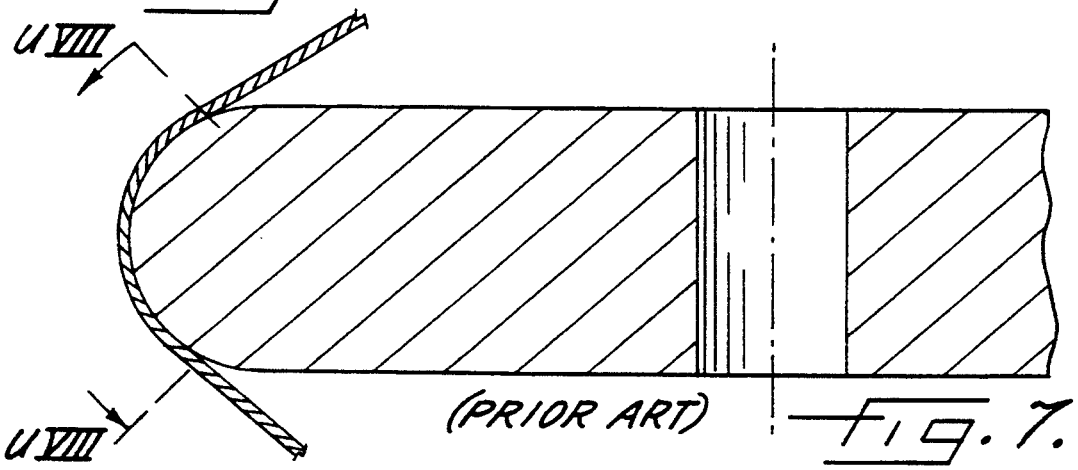
(PRIOR ART) FIG. 7.
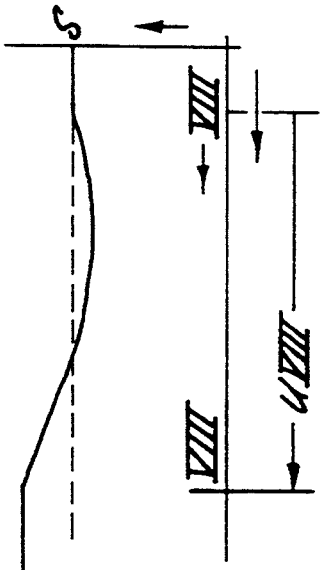
FIG. 8B.
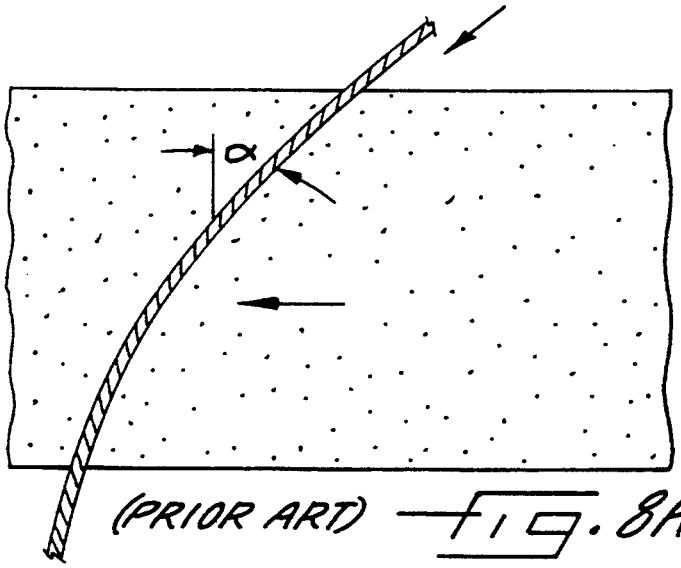
(PRIOR ART) FIG. 8A.

YARN TWISTING DISC

BACKGROUND OF THE INVENTION

The present invention relates to a rotary yarn twisting disc of the type adapted for imparting false twist to an advancing yarn. Twisting discs of the described type are known, and are described for example in U.S. Pat. Nos. 4,115,987 and 3,901,011. In the disclosures of these patents, the discs are used in friction false twist units having three shafts, which are arranged at the corners of an equilateral triangle, and which rotate in the same direction. The discs are mounted to the shafts in such a way that they overlap above the center of the triangle, and the discs form a zigzag operative yarn path of travel extending axially therebetween.

One advantage of the described yarn twisting discs is the fact that they twist and concurrently advance the yarn. As a result, the twisting discs, and the false twisting units in which they are used, may be used for high yarn speeds with a high degree of twist insertion.

The degree of twist and the effect of advancing are theoretically correlated to each other by the angle between the yarn and the tangent to the disc. In static state this angle is the same from tile entrance of the yarn to the exit of the disc. The static angle may be predetermined by the separation of the shafts, the diameter of the discs, and the axial separation of the discs. The tangent of this angle defines the relationship between advance and twist. For setting the apparatus into operation, this theoretical relationship first has to be defined, which is referred to herein as the "predetermined dependence". It has been observed that in addition to the mechanically predetermined dependence, a non-determinable dependence exists between the twist effect and conveying effect, thereby providing a limitation for the yarn speed at a given twist level. It is an object of the present invention to avoid this limitation.

SUMMARY OF THE PRESENT INVENTION

The above and others objects and advantages of the present invention are achieved in the embodiments illustrated herein by the provision of a rotary yarn twisting disc which comprises an annular flange defining a central rotational axis and having an annular yarn contacting peripheral surface over which the yarn is adapted to advance in a direction transverse to the circumferential direction of the surface. The annular yarn contacting peripheral surface consists of first and second annular segments which are axially adjacent each other, with one of the segments having a coefficient of friction and a radius of curvature which are greater than the coefficient of friction and radius of curvature, respectively, of the other segment.

In accordance with the present invention, the yarn contacting peripheral surface of the disc is divided into segments, of which one segment fulfills the functions of imparting twist and conveying the yarn, whereas the other segment fulfills the function of an optimal yarn guide. The yarn guidance segment is designed so as to not adversely effect the yarn conveyance. The division of function permits an optimal friction effect on the one hand, and an optimal yarn guidance on the other hand.

The fact that the segment of relatively high coefficient of friction has a relatively large radius of curvature, is also seen to optimize the friction effect, in that it allows a high friction coefficient to be employed at high friction speeds, without resulting in damage to the multifilament yarn. On the other hand, the thickness of the friction disc is limited to such values as have heretofore been acceptable in the practice and construction of false twisting machines.

The yarn twisting disc of the present invention typically forms a part of a yarn friction false twisting apparatus, which comprises at least three spindles mounted to a bedplate for rotation about fixed, parallel axes which are positioned at the corner points of an equilateral polygon having a number of sides corresponding to the number of spindles. Each spindle fixedly mounts a plurality of the discs, with the discs overlapping at a point centrally between the spindles and so as to define an operative yarn path of travel extending axially therebetween. The spindles are rotated in the same direction, such that twist is imparted to the yarn moving along the operative yarn path of travel by contact with the rotating discs.

One of the features of the present invention is the fact that the axial length of the annular segment having the high coefficient of friction is dimensioned such that the yarn at the point of exit of such segment is still inclined with respect to the axial plane through the point of exit. This inclination permits the degree of twist and the advance of the yarn to be controlled and predicted, which is not possible when the yarn leaves the high friction segment in a direction which is within such axial plane.

BRIEF DESCRIPTION OF THE DRAWINGS

Some of the objects and advantages of the present invention having been stated, others will appear as the description proceeds, when taken in conjunction with the accompanying drawings, in which

FIGS. 5, 6A, and 6B are views corresponding respectively to FIGS. 3, 4A, and 4B, and illustrating a second embodiment of the invention;

FIGS. 7, 8A, and 8B, are views corresponding respectively to FIGS. 3, 4A, and 4B, but illustrating a friction disc of the prior art.

DETAILED DESCRIPTION OF THE PREFERRED EMBODIMENT

Figure 1:
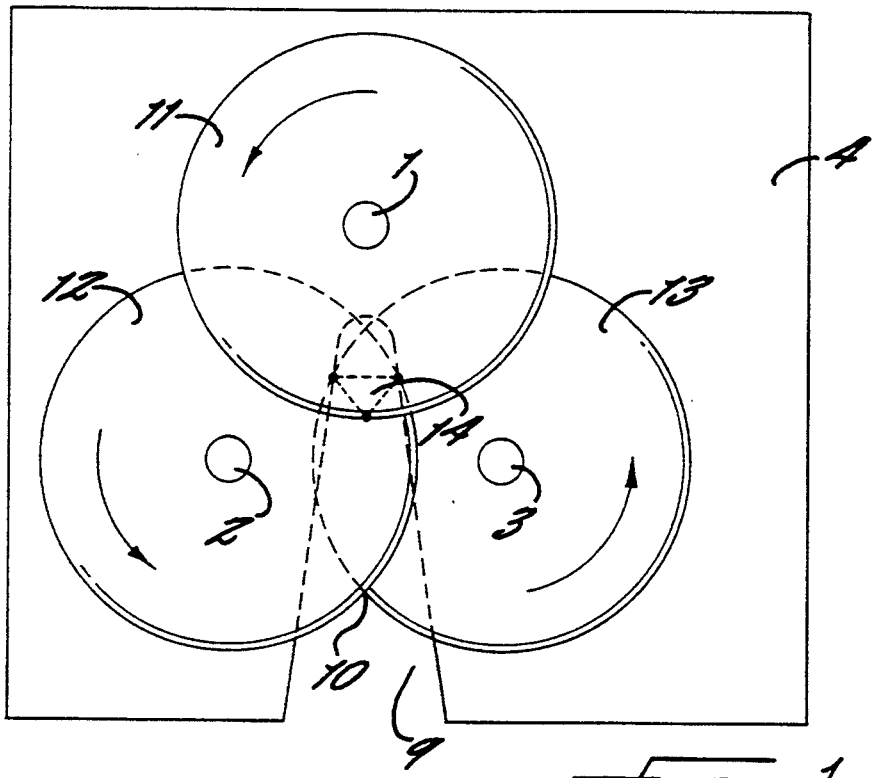
FIG. 1 is a top plan view of a friction false twist apparatus which embodies the features of the present invention.
Figure 2:
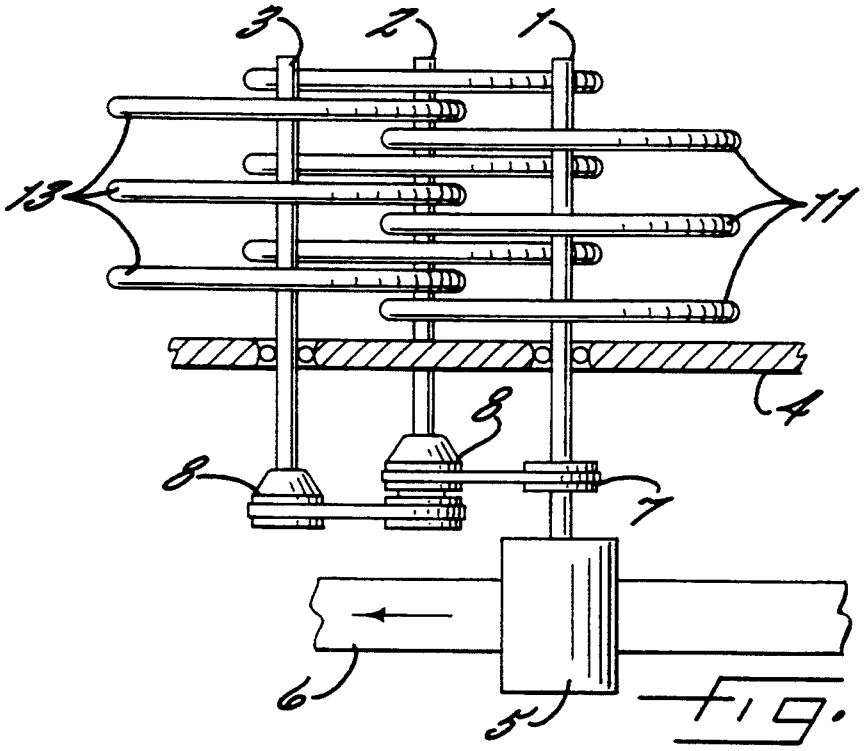
FIG. 2 is a partially sectioned side elevation view of the apparatus.

Referring more particularly to the drawings, a friction false twist apparatus is illustrated in FIGS. 1 and 2 which comprises three shafts 1, 2, 3, which are rotatably supported in a mounting bedplate 4. The shafts are arranged in the corners of an equilateral triangle, and they are driven by a tangential belt 6, which extends along the machine length and rests against a whorl 5. The whorl 5 is mounted on the shaft 1. Shaft 1 drives the other shafts 2 and 3 via belt pulleys 7 and 8 as well as small drive belts, in the same direction. Mounted on the shafts 1, 2, 3 are yarn twisting discs 11, 12, 13, in the present embodiment three each, in such a manner that they overlap in a central region 14. The overlapping region 14 lies at the center of the equilateral triangle, in whose corners the shafts 1, 2, 3 are arranged. The bedplate 4 is provided with a threading slot 9, which extends from the edge to the central overlapping region 14 of the discs. In the region of the threading slot 9, the discs 12 and 13 form a cusp 10, into which a yarn is inserted, so that it reaches the overlapping region 14.

Figure 3:
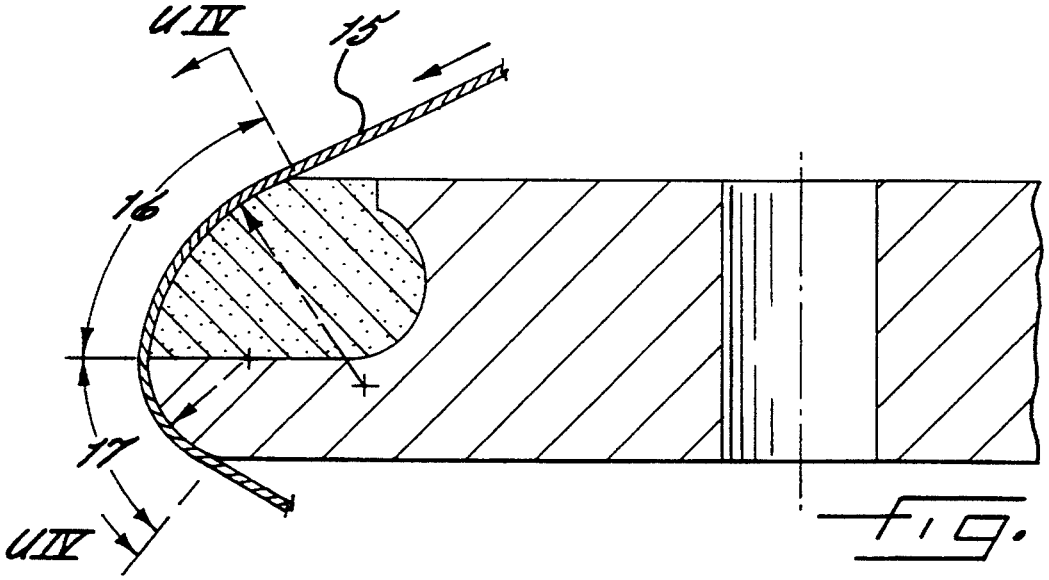
FIG. 3 is an enlarged fragmentary sectional view of the outer peripheral portion of one of the yarn twisting discs of the apparatus shown in FIGS. 1 and 2.
Figure 4A:
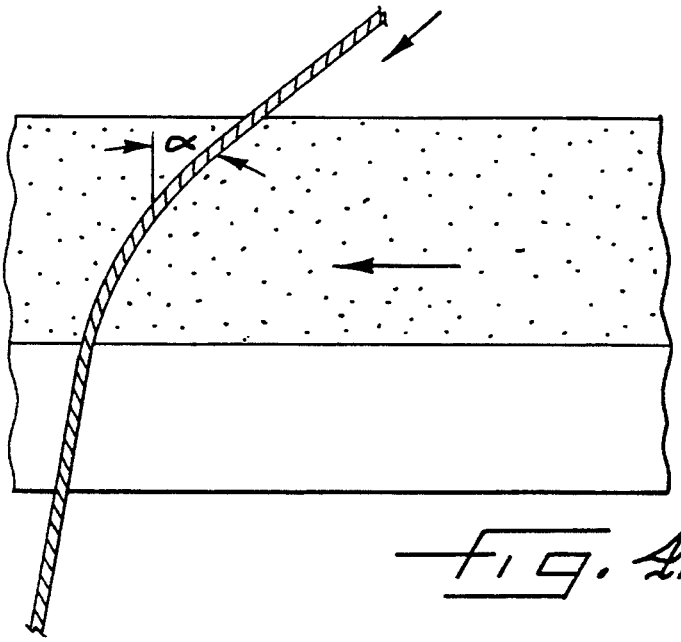
FIG. 4A is a projection of the peripheral surface of the disc shown in FIG. 3.
Figure 5:
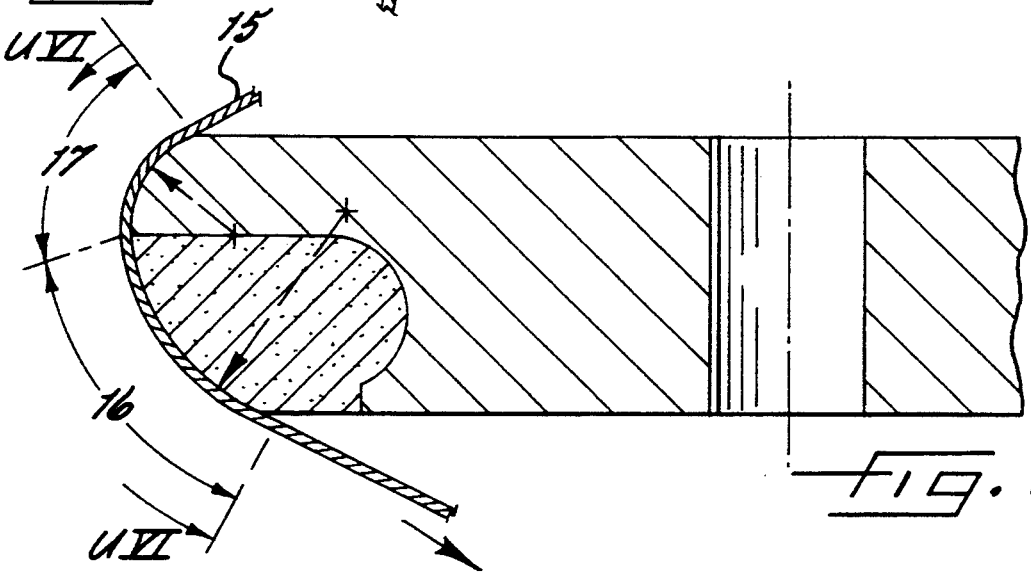

The design and construction of the yarn twisting discs of the present invention are illustrated in FIGS. 3 and 5. A disc of the prior art is shown in FIG. 7. However, the following description will apply to all of these discs. More particularly, the discs possess a spherical peripheral surface, over which an advancing yarn 15 travels. In so doing, the yarn 15 partially loops about the spherical peripheral surface. The range of looping is indicated at UIV (FIG. 3) or UVI (FIG. 5) or UVIII (FIG. 7). Also it is noteworthy that due to the geometry of the friction false twist unit, a yarn path of travel results, in which the yarn is guided so as to be inclined to the tangent of the circumference of the disc. In the present application, the angle of inclination alpha is described as the complementary angle to the angle between the yarn and the circumferential tangent. This angle of inclination alpha is constant in the static condition over the entire looping range U. However, the movement of the circumference of the disc results in a retardation of the yarn. To illustrate this retardation of the yarn, a projection of the circumference is shown in FIGS. 4A, 6A and 8A. These projections are a linear illustration of the spherical circumference of the disc, both in the circumferential direction and in the axial direction.

The yarn twisting discs of the present invention as illustrated in FIGS. 3 and 5 include an annular yarn contacting peripheral surface over which the yarn is adapted to advance, and the surface comprises annular segments with different coefficients of friction, i.e., a segment 16 of relatively high friction, hereinafter "friction zone," and a segment 17 of relatively low friction, hereinafter "guide zone." As a specific example, relative to the yarn, the friction zone typically has a coefficient of friction of about 0.25, and the coefficient of friction of the guide zone is about 0.1.

Another feature common to both embodiments of FIGS. 3 and 5 is that the friction zone has a larger radius of curvature than the guide zone. There is a direct dependence between the coefficient of friction and the radius of curvature, namely, the greater the coefficient of friction the larger is the radius of curvature. However, it is not necessary that there exist a strict proportionality. Rather, the following reason is decisive as a result of a large radius of curvature, the disc becomes very thick. This is undesirable in the construction of machines. On the other hand, the contact zone cannot become randomly short, since this would lead to unacceptable surface pressures between the yarn and the disc. Surface pressures need to be kept low especially when the disc has a high coefficient of friction.

The radius of curvature of the disc, which determines the length of the line of contact in the friction zone, should thus be designed in accordance with the permissible surface pressure. The permissible surface pressure can be determined only from tests and experience, and is highly dependent on the material of both the friction surface and the yarn. In comparison, the radius of curvature of the guide zone is selected to be as small as is useful in the construction of machines for obtaining a small thickness of the discs, and for guiding the yarn. For example, the radius of curvature of the friction zone can amount to about 7 mm and that of the guide zone to about 2 mm. It is possible to arrange the zones of different friction in a different sequence in the direction of the material flow. In the embodiment of FIG. 3, the friction zone 16 is at the inlet end and the guide zone 17 is at the outlet end of the friction disc.

The above construction results, as is shown in FIG. 4A, in the following pattern: the yarn first contacts the friction disc, i.e. it enters into the friction zone, at an angle of inclination alpha, which is substantially dependent on the geometric design of the friction false twist unit and the given guidance of the yarn. However, as the yarn continues to pass through the friction zone, it is subjected to considerable drag in the direction of rotation of the disc which results is a reduction of the angle of inclination alpha. Consequently, the component of movement of the circumferential speed of the friction disc, which points in direction of the yarn axis and, thus, is active in conveying, becomes smaller. However, the angle of inclination does not reach zero. To this end, the length of the friction zone 16 is limited. Before the angle of inclination alpha reaches zero, the friction zone 16 merges into the guide zone 17, which has only low friction. However, in the zone of low friction the drag on the yarn is low. Consequently, there is no further decrease of the angle alpha. The arrangement of the guide zone thus effects that the yarn leaves the friction zone at an minimum angle alpha and is therefore always subjected to a positive, and by no means, however, a negative effect of conveyance.

Figure 4B:
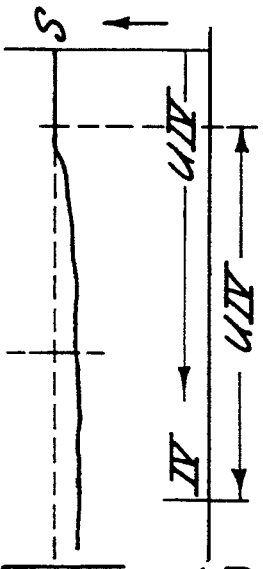
FIG. 4B is a diagram of the yarn tension along the peripheral surface of the disc shown in FIG. 3.

The yarn tension diagram of FIG. 4B illustrates the effect on the yarn tension. In the inlet region of the yarn into the friction zone, the yarn tension S first undergoes a decrease. However, the decrease of the yarn tension does not continue, since the angle of inclination alpha and, thus, the effect of conveyance of the friction disc become smaller. Upon reaching the guide zone, however, the yarn tension remains substantially constant.

Shown in FIGS. 7 and 8 is a friction disc of the prior art. In these Figures, the looping range UVIII has a uniform coefficient of friction. This means that, as is shown in FIG. 8B, at the beginning of the friction zone the yarn tension decreases likewise. However thereafter, the angle of inclination changes so decisively that the yarn tension increases again. When the yarn leaves the friction disc, its tension is higher than at the inlet end of the friction disc. This shows that the effect of conveyance is negative at the outlet end of the disc.

In the embodiment of FIGS. 5 and 6, the yarn advances first over the guide zone 17 and then over the friction zone 16. The retardation of the yarn, which occurs in this process, is shown in FIG. 6A, and the course of the yarn tension in FIG. 6B. Also here, it is possible to obtain a drop of the yarn tension toward the outlet end of the friction disc. However, this arrangement has the further advantage that the twist insertion and effect of conveyance as a whole are more effective. Apparently, this results from the fact that the yarn leaves the friction zone in the area of the smaller diameter of the friction disc, and not in the region of the largest diameter as is the case in the embodiment of FIG. 3.

In the drawings and specification, there has been set forth a preferred embodiment of the invention, and although specific terms are employed, they are used in a generic and descriptive sense only and not for purposes of limitation.

That which is claimed is:

1. A rotary yarn twisting disc adapted for imparting twist to an advancing yarn, comprising;

an annular flange defining a central rotational axis and having an annular yarn contacting peripheral surface over which the yarn is adapted to advance in a direction transverse to the circumferential direction of said surface, said annular yarn contacting peripheral surface consisting of first and second annular segments which are axially adjacent each other, one of said segments having a coefficient of friction and a radius of curvature which are greater than the coefficient of friction and radius of curvature, respectively, of the other segment; said radius of curvature of said one segment being substantially uniform.

2. The rotary yarn twisting disc as defined in claim 1 wherein said first and second annular segments are axially juxtaposed and comprise the entirety of said annular yarn contacting peripheral surface.

3. The rotary yarn twisting disc as defined in claim 2 wherein the coefficient of friction of said one segment is about 0.25, and the coefficient of friction of said other segment is about 0.1.

4. The rotary yarn twisting disc as defined in claim 3 wherein the radius of curvature of said one segment is about 7 mm and the radius of curvature of the other segment is about 2 mm.

5. An apparatus for friction false twisting an advancing yarn, comprising;

a mounting bedplate, at least three spindles mounted to said bed-plate for rotation about fixed, parallel axes which are positioned at the corner points of an equilateral polygon having a number of sides corresponding to the number of spindles, with each spindle fixedly mounting a plurality of circular discs and with marginal portions of the discs of the spindles overlapping interdigitally at a point centrally between said spindles and so as to define an operative yarn path of travel extending axially therebetween, means for concurrently rotating each spindle in a common direction and such that twist is imparted to a yarn moving along said operative yarn path of travel by contact with the rotating discs, the improvement comprising: each of said discs comprises an annular flange mounted coaxially about the rotational axis of the associated spindle and having an annular yarn contacting peripheral surface over which the yarn is transversely advanced during its advance along said path of travel, said annular yarn contacting peripheral surface consisting of first and second annular segments which are axially adjacent each other, with one of said segments having a coefficient of friction and radius of curvature which are greater than the coefficient of friction and radius of curvature, respectively, of the other of said segments, said radius of curvature of said one segment being substantially uniform.

6. The apparatus as defined in claim 5 wherein said other segment of each disc precedes said one segment when viewed in the direction of yarn advance through said apparatus.

7. The apparatus as defined in claim 5 wherein the radius of curvature of said one segment is about 7 mm and the radius of curvature of said other segment is about 2 mm.

* * * * *